United States Patent [19]

Poppenheimer

[11] Patent Number: 4,999,757

[45] Date of Patent: Mar. 12, 1991

[54] NICHE MOUNTED LIGHT FIXTURE

[75] Inventor: Charles B. Poppenheimer, La Canada-Flintridge, Calif.

[73] Assignee: GTY Industries, Sylmar, Calif.

[21] Appl. No.: 394,360

[22] Filed: Aug. 15, 1989

[51] Int. Cl.[5] ..... F21Y 21/30

[52] U.S. Cl. ..... 362/287; 362/96; 362/365; 362/419

[58] Field of Search ..... 362/96, 287, 364, 365, 362/366, 419, 427, 767

[56] References Cited

U.S. PATENT DOCUMENTS

| | | | |
|---|---|---|---|
| 2,434,108 | 1/1948 | Handler | 362/364 |
| 2,716,185 | 8/1955 | Burliuk et al. | 362/364 |
| 3,778,609 | 12/1973 | Liberman | 362/364 |
| 4,232,361 | 11/1980 | Kelsall | 362/364 |
| 4,623,956 | 11/1986 | Conti | 362/364 |
| 4,887,196 | 12/1989 | Brown et al. | 362/364 |

*Primary Examiner*—Ira S. Lazarus

*Assistant Examiner*—Richard R. Cole

*Attorney, Agent, or Firm*—Lyon & Lyon

[57] ABSTRACT

A light fixture mounted in a niche can having two degrees of freedom of adjustment so as to provide universal orientation. A lamp housing is mounted to an inner ring which is mounted by a pivot assembly to an outer ring. The inner ring may be pivoted relative to the outer ring and locked in a particular orientation relative thereto. The outer ring is positioned in a niche can and may be rotated in the can about an axis which is substantially perpendicular to the axis of the pivot assembly. A lock assembly selectively locks the outer ring in the niche can to fix the orientation of the lamp. The inner ring may be removed from the mounting system of the pivot assembly for relamping. A retrofit stand can mount the outer ring such that it can be pivoted about an axis which is also perpendicular to the axis of the pivot assembly to again provide universal orientation of the light.

15 Claims, 3 Drawing Sheets

FIG. 3.
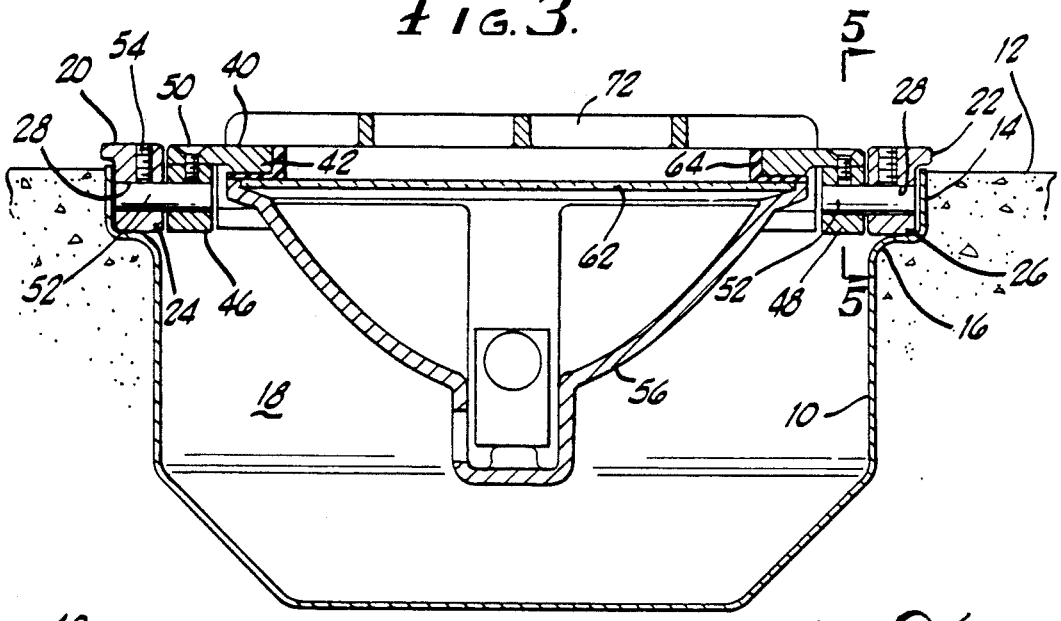
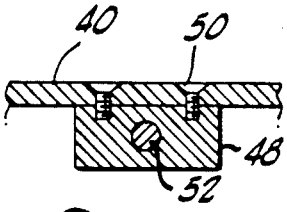
FIG. 5.
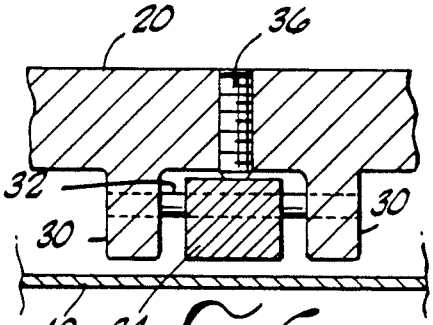
FIG. 6.
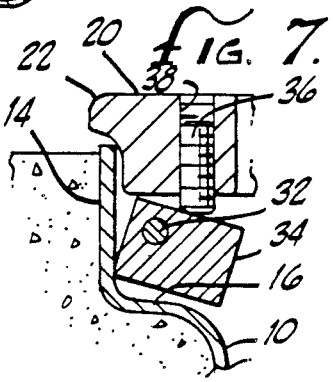
FIG. 7.
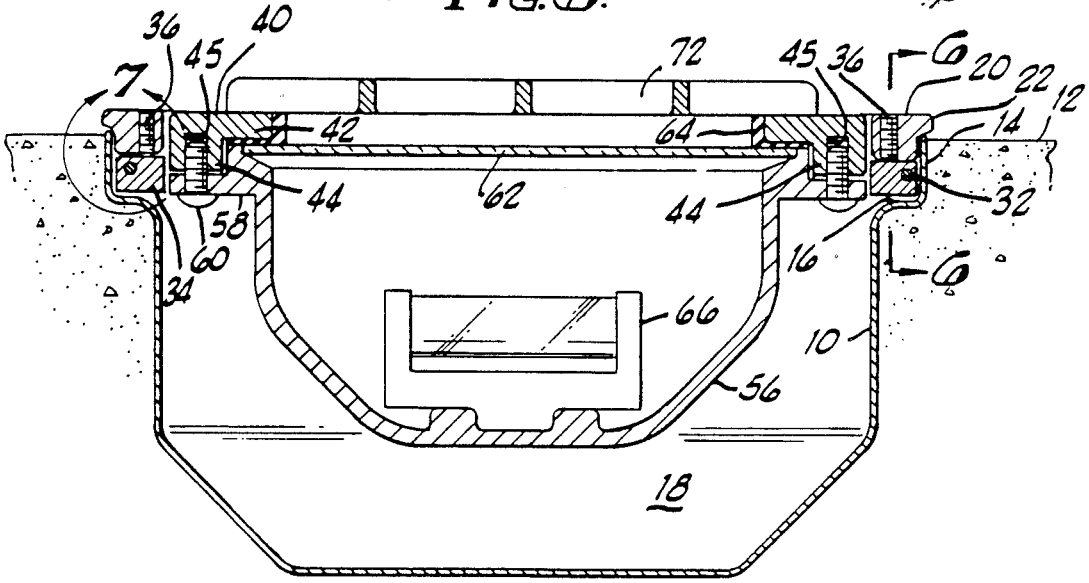
FIG. 4.

NICHE MOUNTED LIGHT FIXTURE

BACKGROUND OF THE INVENTION

The field of the present invention is mounting structures for light fixtures allowing aiming of the light.

Light fixtures have long been employed for mounting lamp housings in utilitarian and/or decorative applications where the lamp may be selectively oriented. In some applications, light fixtures are preferably mounted in recesses or niches in structures such as the bottom and sides of fountains. However, recessed mountings are typically incompatible with light fixtures capable of lamp orientation. When flush mounted, lamp orientation is difficult as little access into the niche is possible. Often lenses are used to direct the light to overcome such problems. In addition, building codes typically require that the lamp be removable for replacement.

In the particular case of fountain lighting, where niche mounted light fixtures are often desired, the desired orientation of the lamp for decorative effect is difficult to achieve except in darkened conditions with the fountain on. Once set, it is preferable to retain the orientation of the lamp until such time as the fountain is redesigned. Consequently, relamping without disturbing the fixture orientation is most advantageous.

SUMMARY OF THE INVENTION

The present invention is directed to niche mountable light fixtures which allow orientation of the lamp, a locking of that orientation, and repeated removal of the light housing for relamping. All of this may be accomplished with access only to the surface of the assembly outwardly of the niche.

In a first aspect of the present invention, a lamp fixture is contemplated having an inner ring pivotally mounted to an outer ring which is in turn rotatably positioned in a niche. The two degrees of freedom defined by the pivot mounting of the inner ring and the rotatable mounting of the outer ring provide for a substantial range of lamp orientation.

In a further aspect of the present invention, a lock assembly is associated with the outer ring to fix the assembly in the niche. The orientation of the inner ring relative to the outer ring may also be fixed. A mechanism for accomplishing such locking may include set screws accessible from the outer surface of the assembly, outwardly of the niche.

In another aspect of the present invention, the inner ring may be removably associated with the pivot assembly for relamping under dry conditions. This separation of the inner ring from the pivot assembly allows the orientation of the mounting structure to be retained. Use of fastening mechanisms unique to the assembly may ensure that the light rather than the mounting system is disassembled for relamping.

Accordingly, it is an object of the present invention to provide an improved adjustable light fixture. Other and further objects and advantages will appear hereinafter.

BRIEF DESCRIPTION OF THE DRAWINGS

FIG. 3 is a cross-sectional view taken along line 3—3 of FIG. 1.

FIG. 4 is a cross-sectional view taken along line 4—4 of FIG. 1.

FIG. 5 is a cross-sectional detail view taken along line 5—5 of FIG. 3.

FIG. 6 is a cross-sectional detail view taken along line 6—6 of FIG. 4.

FIG. 7 is a cross-sectional detail view as seen in FIG. 4 at area 7.

DETAILED DESCRIPTION OF THE PREFERRED EMBODIMENTS

Figure 1:
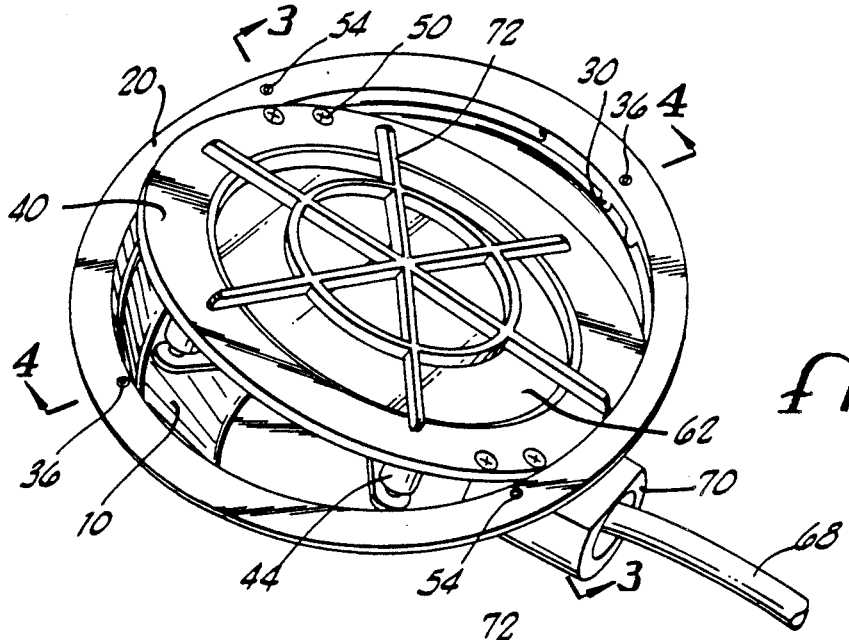
FIG. 1 is an oblique view of a light fixture of the present invention.
Figure 2:
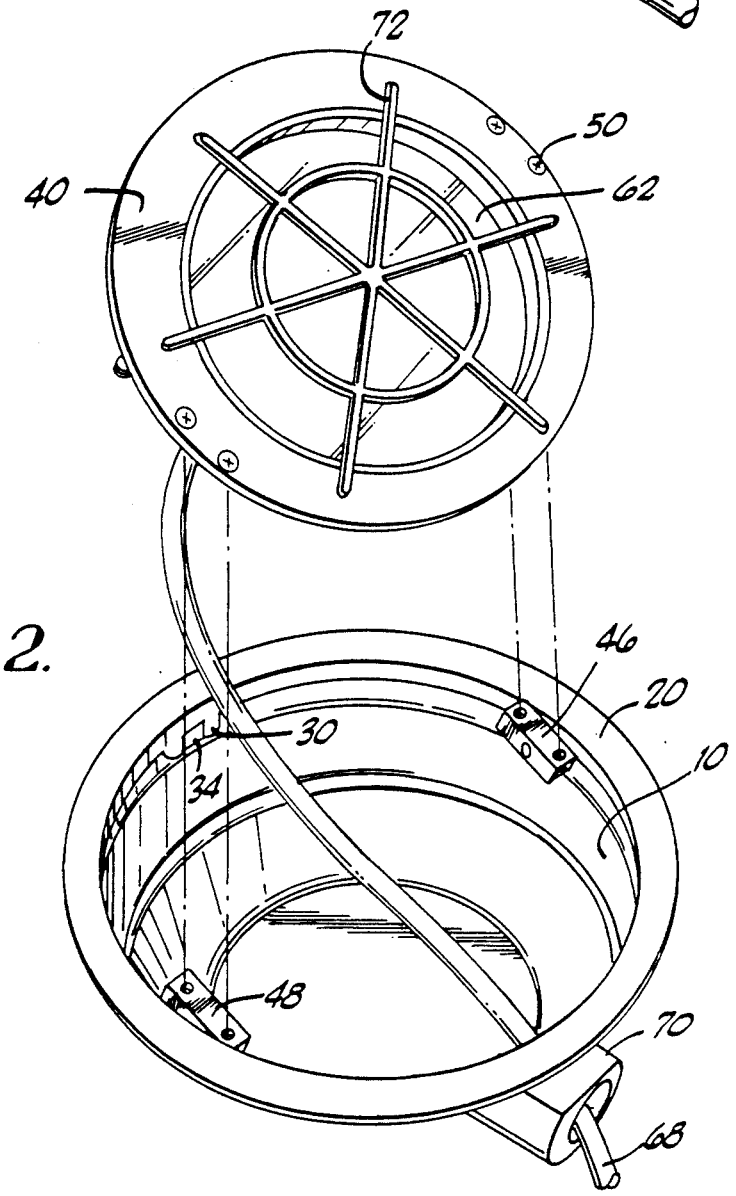
FIG. 2 is a partially exploded oblique assembly view of the light fixture of the present invention.

Turning in detail to the drawings, a light fixture is illustrated in a first embodiment in FIGS. 1–7. As can be seen from FIGS. 3 and 4, the fixture is shown to be mounted in a niche. A permanently mounted niche can 10 is embedded within the structure 12, shown to be concrete in the present example. The niche can 10 has a circular opening defined by a cylindrical wall 14. A circular seat 16 extends radially inwardly from the cylindrical wall 14. A niche cavity 18 extends inwardly therefrom as defined by the shape of the can 10.

Positioned in the can 10 so as to be concentrically mounted within the cylindrical wall 14 and resting on the seat 16 is an outer ring 20. The outer ring 20 includes a lip 22 extending over the upper edge of the niche can 10. The outer ring extends downwardly in a thin flange, identified in FIG. 8 by number 23, about most of its periphery. At two diametrically opposed locations, the downwardly extending flange is thickened to provide pivot blocks 24 and 26. The pivot blocks 24 and 26 extend downwardly to the same extent as the flange. The diametrically opposed pivot blocks 24 and 26 each include a bore 28. The bores 28 are aligned along a common axis. The pivot blocks 24 and 26 form a part of a pivot assembly also associated with the inner ring of the device.

Positioned at approximately 90 degrees about the outer ring 20 from the pivot blocks 24 and 26 are two sets of pin mounting bosses 30. Two pin mounting bosses 30 are associated with each set and are configured to receive a pin 32. The downwardly extending flange 23 does not extend to the pin mounting bosses 30 so that access may be had to the pin mounting bosses 30 for placement of the pin 32. The mounting bosses 30 and pins 32 are part of a lock assembly employed in association with the niche can 10.

The lock assembly is illustrated in the preferred embodiment as having two locking mechanisms which are diametrically opposed about the outer ring 20. The locking mechanisms include a wedge block 34 mounted on each pin 32 in turn mounted to the outer ring 20 in the pin mounting bosses 30. The wedge block 34 is conveniently rectangular in cross-section, but may assume any shape capable of wedging against the niche can 10. FIG. 7 illustrates a wedge block 34 in a locked position. To position and retain each wedge block 34 in the locked position, a set screw 36 is positioned through a hole 38 in the outer ring 20. The set screw is offset from the pin 32 such that the wedge block 34 is rotated by advancement of the set screw 36. This results in engagement of the wedge block 34 in the niche can 10. The hole 38 extends through the outer ring 20 from the outer surface of the ring. Thus, access for locking and unlocking of each locking mechanism of the lock assembly may be accomplished from the face of the fixture. When unlocked, the outer ring 20 may be rotated in as well as removed from the niche can 10. As will be presented below, this rotation provides a degree of freedom for orientation of the lamp.

Positioned inwardly of the outer ring 20 is an inner ring 40. The inner ring 40 is illustrated in the preferred embodiment to include an inwardly extending flange portion 42 for retention and sealing of the lens. Spaced at equiangular locations about the inner ring 40 on the underside thereof are mounting bosses 44 which extend downwardly and include threaded holes 45 therein for mounting to a lamp housing. At diametrically opposed locations on the inner ring 40, there are mounting positions for a pivot assembly.

The pivot assembly includes the aforementioned pivot blocks 24 and 26 located on the outer ring 20. Opposed to these pivot blocks 24 and 26 on the inner ring 40 are yoke blocks 46 and 48. The yoke blocks 46 and 48 are held to the underside of the inner ring 40 by means of removable fasteners 50. The fasteners 50 are presented through the inner ring 40 such that they are exposed for manipulation on the outer side of the fixture. In each yoke block 46 and 48, a pivot pin 52 is held such that it extends outwardly into a bore 28 in the pivot blocks 24 and 26. The pivot pins 52 are preferably press fit into the yoke blocks 46 and 48 so that they will not rotate therein. At the same time, the pivot pins 52 are capable of rotating within the bores 28. Locks for the pivot pins 52 are provided by set screws 54 extending through the outer ring 20 from the outer surface thereof. As with the set screws 36 and the removable fasteners 50, the set screws 54 are accessible from outside of the fixture. The set screws 36 and 54 which are employed to fix the orientation of the lamp employ a different head, preferably requiring an Allen wrench, than the removable fasteners 50, shown to require a Phillips head screwdriver. This difference assists maintenance for relamping. By requiring a Phillips head screwdriver, one cannot mistakenly change the locked orientation of the light. The pivot assembly provides a second degree of freedom for the adjustment of lamp orientation. By employing both the pivot axis of the pivot assembly and the rotatable mounting of the outer ring 20 in the can 10, substantially all useful lamp orientations can be achieved.

The inner ring 40 is located about the periphery of a lamp housing 56. The lamp housing 56 includes an outwardly extending mounting flange 58 having holes spaced to meet with the holes 45 in the mounting bosses 44 of the inner ring 40. Fasteners 60 retain the inner ring 40 and the lamp housing 56 together. A lens 62 is positioned o the lamp housing 56 and a gasket 64 extends around the inwardly extending flange portion 42 and between the lens 62 and the flange portion 42. In this way, a seal is created to prevent moisture intrusion into the lamp housing 56. A lamp 66 is located within the lamp housing 56 and is electrically coupled to a cable which extends through the lamp housing 56 in a sealed manner. The cable 68 also extends through a port 70 in the wall of the niche can 10 to a conduit embedded in the fountain or other structure 12. Integrally formed for convenience with the inner ring 40 is a protective grill 72 which extends across the lamp housing 56 to protect the lens 62.

Figure 8:
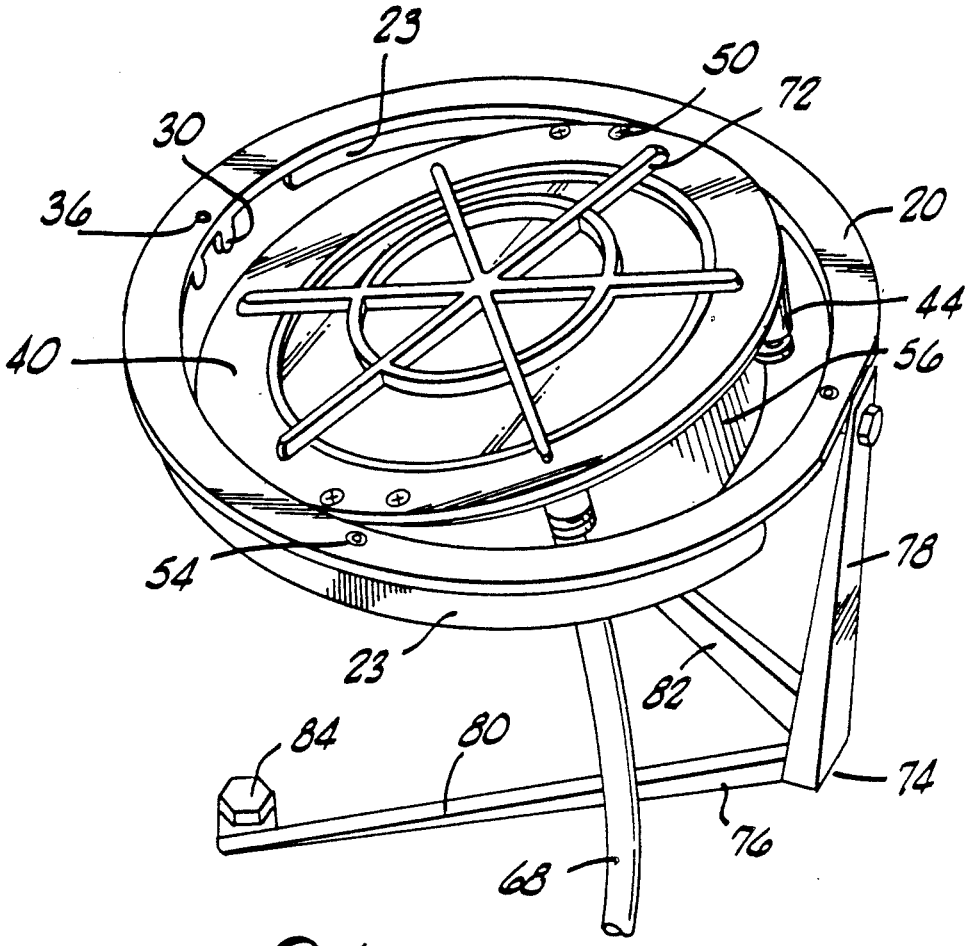
FIG. 8 is an alternate embodiment for a lamp retrofit shown in a oblique view.

Turning to FIG. 8, a retrofit embodiment is illustrated which may use the foregoing assembly with the exception of the niche can 10. A stand 74 includes a mounting base 76 and an upstanding mount 78. The mounting base 76 includes three slots, one at each end of the legs 80 and 82 of the mounting base 76 and one located centrally adjacent the stand 74. Each may be bolted to the underlying structure. The mount 78 has a hole located at its upper end for receipt of a fastener 84. A threaded hole is provided in the outer ring 40 for receipt of the fastener 84. This hole in the outer ring 40 is located at approximately 90 degrees from the pivot blocks 24 and 26 of the pivot assembly. In this way, two axes which are substantially perpendicular to one another are presented for universal orientation of the light.

Thus, an improved light fixture is disclosed having particular applicability for mounting in a niche and the capability to be oriented, locked and relamped through access from the upper surface of the device. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A niche mounted light fixture comprising:

a lamp housing sealed against water entry and having an outer periphery;

an inner ring fixed to said lamp housing about said outer periphery of said lamp housing;

an outer ring mounted about said inner ring and positionable in the niche to rotate therein;

a pivot assembly fixed between said inner ring and said outer ring and mounting said inner ring and said lamp housing to pivot relative to said outer ring in the niche, said pivot assembly including a lock to restrict pivotal movement of said inner ring relative to said outer ring, said lock being mounted on said outer ring, and removable fasteners, said inner ring being mounted to said pivot assembly by said removable fasteners and wherein said lamp housing and said inner ring may be removed from said niche and said outer ring;

a lock assembly operably mounted to said outer ring to selectively lock said outer ring in the niche.

2. The niche mounted light fixture of claim 1 wherein said pivot assembly includes pivot blocks and pivot pins, said pivot pins being rotatably positioned in said pivot blocks, respectively.

3. The niche mounted light fixture of claim 2 wherein said pivot blocks are on said outer ring and said pivot pins are mounted on said inner ring and extend outwardly to said pivot blocks.

4. The niche mounted light fixture of claim 3 wherein said lock selectively fixes said pivot pins from rotating in said pivot blocks.

5. The niche mounted light fixture of claim 1 further comprising a niche can having a circular opening, said outer ring fitting within said circular opening for said lock assembly to selectively engage the niche can at said circular opening.

6. A niche mounted light fixture comprising:

a lamp housing;

an inner ring fixed to said lamp housing about said lamp housing;

an outer ring mounted about said inner ring and positionable in the niche to rotate therein;

a pivot assembly fixed between said inner ring and said outer ring and mounting said inner ring and lamp housing to pivot relative to said outer ring in the niche, said pivot assembly including yoke blocks and removable fasteners, said yoke blocks being fixed to said inner ring by said removable fasteners, pivot blocks positioned on said outer ring, pivot pins, said pivot pins being fixed in said yoke blocks and extending to be pivotally mounted in said pivot blocks and set screws to selectively fix said pivot pins in said pivot blocks;

a lock assembly including wedge blocks operably mounted to said outer ring and set screws to selectively advance said wedge blocks into engagement with the niche.

7. A light fixture comprising: a lamp housing;

an inner ring fixed to said lamp housing about said lamp housing;

an outer ring mounted about said inner ring;

a pivot assembly fixed between said inner and outer rings and mounting said inner ring and lamp housing to pivot relative to said outer ring, said pivot assembly including yoke blocks, removable fasteners, said yoke blocks being fixed to said inner ring by said removable fasteners, pivot blocks on said outer ring, pivot pins fixed in said yoke blocks and extending to rotational mounting in said pivot blocks and set screws extending through said pivot blocks to said pivot pins to selectively lock said pivot pins from rotation relative to said pivot blocks, said set screws and said removable fasteners having different heads for manipulation by different tools.

8. The light fixture of claim 7 wherein there are two said pivot pins mounted relative to said inner ring in diametrically opposed positions.

9. The light fixture of claim 7 further comprising a stand, said outer ring being mounted about a first axis to said stand for selective relative rotation between said stand and said outer ring, said axis being oriented at substantially 90 degrees to said pivot pins.

10. The light fixture of claim 7 further comprising a niche can, said outer ring being positionable in said niche can to rotate therein, and a lock assembly operatively mounted to said outer ring to selectively lock said outer ring with said niche can.

11. A niche mounted light fixture comprising:

a lamp housing having an outer periphery;

an inner ring fixed to said lamp housing about said outer periphery of said lamp housing;

an outer ring mounted about said inner ring and positionable in the niche to rotate therein;

a pivot assembly fixed between said inner ring and said outer ring and mounting said inner ring and said lamp housing to pivot relative to said outer ring in the niche, said pivot assembly including pivot blocks and pivot pins, said pivot pins being rotatably positioned in said pivot blocks, respectively, said pivot blocks being on said outer ring and said pivot pins being mounted on said inner ring and extending outwardly to said pivot blocks, said pivot assembly further including yoke blocks, said pivot pins being mounted therein, and removable fasteners, said yoke blocks being affixed to said inner ring by means of said removable fasteners;

a lock assembly operably mounted to said outer ring to selectively lock said outer ring in the niche.

12. The niche mounted light fixture of claim 11 wherein said yoke blocks are fixed to said inner ring between said inner ring and the niche.

13. The niche mounted light fixture of claim 12 wherein said pivot assembly includes a set screw to fix said pivot pins from rotating in said pivot blocks, said removable fasteners and said set screw having heads for different tools.

14. A niche mounted light fixture comprising:

a lamp housing;

an inner ring fixed to said lamp housing about said lamp housing;

an outer ring mounted about said inner ring and positionable in the niche to rotate therein;

a pivot assembly fixed between said inner ring and said outer ring and mounting said inner ring and said lamp housing to pivot relative to said outer ring in the niche;

a lock assembly operably mounted to said outer ring to selectively lock said outer ring in the niche, said lock assembly including a pivotally mounted wedge block and a set screw.

15. A niche mounted light fixture comprising:

a lamp housing;

an inner ring fixed to said lamp housing about said lamp housing;

an outer ring mounted about said inner ring and positionable in the niche to rotate therein;

a pivot assembly fixed between said inner ring and said outer ring and mounting said inner ring and said lamp housing to pivot relative to said outer ring in the niche;

a lock assembly operably mounted to said outer ring to selectively lock said outer ring in the niche, said lock assembling including pivotally mounted wedge blocks diametrically opposed on said outer ring and set screws extending through said outer ring to engage said wedge blocks, respectively.

* * * * *